US007909322B2

(12) United States Patent
Kobayashi

(10) Patent No.: US 7,909,322 B2
(45) Date of Patent: Mar. 22, 2011

(54) SKEW CORRECTION DEVICE AND RECORDING APPARATUS WITH ROTATING MEMBER INCLUDED IN A GUIDE MEMBER

(75) Inventor: Yutao Kobayashi, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/637,226

(22) Filed: Dec. 14, 2009

(65) Prior Publication Data

US 2010/0156039 A1 Jun. 24, 2010

(30) Foreign Application Priority Data

Dec. 18, 2008 (JP) ..... 2008-322205

(51) Int. Cl.
*B65H 9/04* (2006.01)

(52) U.S. Cl. ..... 271/242; 271/188; 271/209

(58) Field of Classification Search ..... 271/188, 271/209

See application file for complete search history.

(56) References Cited

U.S. PATENT DOCUMENTS

| | | | | |
|---|---|---|---|---|
| 4,365,795 | A * | 12/1982 | Fukushima et al. | 271/242 |
| 4,438,918 | A * | 3/1984 | Ito et al. | 271/251 |
| 4,790,524 | A * | 12/1988 | Murakami et al. | 271/242 |
| 5,428,431 | A * | 6/1995 | Abe et al. | 271/245 |
| 5,822,672 | A * | 10/1998 | Johdai et al. | 271/227 |
| 6,733,008 | B2 * | 5/2004 | Waragai et al. | 271/242 |

FOREIGN PATENT DOCUMENTS

JP 08-295439 11/1996

* cited by examiner

*Primary Examiner* — Stefanos Karmis
*Assistant Examiner* — Gerald W McClain
(74) *Attorney, Agent, or Firm* — Workman Nydegger

(57) ABSTRACT

A skew correction device including a first guide member which supports the sheet transported by the transport roller from a lower side thereof in a vertical direction and guides the sheet to the gate member, and a second guide member which is provided on an upper position from the first guide member in a vertical direction and which guides the sheet to the gate member. Here, the first guide member includes at least one rotating member which faces a transport passage of the sheet interposed between the first guide member and the second guide member and is rotatably provided at least in the center of the second guide member in a width direction intersecting a transport direction of the sheet.

5 Claims, 3 Drawing Sheets

SKEW CORRECTION DEVICE AND RECORDING APPARATUS WITH ROTATING MEMBER INCLUDED IN A GUIDE MEMBER

BACKGROUND

1. Technical Field

The present invention relates to a skew correction device and a recording apparatus which is provided with the skew correction device.

2. Related Art

In the past, ink jet printers (hereinafter, referred to as "printer") have been widely known as recording apparatuses which attach a recording material (ink) to sheets. The printer ejects ink, which is supplied to recording heads, from nozzles formed in the recording heads to a sheet such as a recording paper, so as to perform printing (recording).

In such a printer, when the sheet is transported in an inclined state, there is some concern that wrinkles or folds may occur and the printing may be performed on the inclined sheet, so that the printing quality is degraded. Here, for example, as described in JP-A-8-295439, there is disclosed a printer which is provided with a mechanism for correcting inclination (skew) of the sheet which is supplied in an inclined state with respect to a transport passage.

That is, in the printer as described in JP-A-8-295439, the sheet is delivered from an upstream side to a downstream side in the transport direction of the sheet in accordance with the rotation of a transport roller, and the tip end which is a downstream end of the sheet comes into contact with a resist roller which stops rotating, so that the vicinity of the tip end of the sheet is bent. For this reason, the sheet rotates in order to remove the inclination with respect to the transport passage so as to correct skew thereof. Thereafter, the sheet is transported to a printing unit which performs the printing in accordance with the rotational driving of a resist roller with which the tip end comes into contact.

In the printer as described in JP-A-8-295439, ribs are formed in a guide unit which guides the delivered sheet, so that a contact area between the guide unit and the sheet is decreased. That is, frictional resistance between the sheet and the guide unit is reduced, so that the rotation of the sheet is smoothly carried out.

However, for example, when a sheet with high rigidity is supplied, the bent sheet strongly comes into contact with the guide unit. For this reason, the frictional resistance between the sheet and the guide unit becomes larger, and thus there is some concern that the sheet may not sufficiently rotate, so that the inclination of the sheet is not corrected.

SUMMARY

An advantage of some aspects of the invention is to provide a skew correction device and a recording apparatus, in which a sheet sufficiently rotates at the time of correcting a skew, so that the skew of the sheet can be corrected regardless of the type of the sheet.

According to an aspect of the invention, there is provided a skew correction device which performs positional correction of a sheet while a tip end of the sheet transported in accordance with rotation of a transport roller comes into contact with a gate member so as to deform the sheet to be bent, including: a first guide member which supports the sheet transported by the transport roller from a lower side thereof in a vertical direction and guides the sheet to the gate member; and a second guide member which is provided on an upper position from the first guide member in a vertical direction and guides the sheet to the gate member. Here, the first guide member includes at least one rotating member which faces a transport passage of the sheet interposed between the first guide member and the second guide member and is rotatably provided at least in the center of the second guide member in a width direction intersecting a transport direction of the sheet. In addition, the rotating member is provided to protrude more into the transport passage in a case where the rotating member is provided in the center in the width direction than in a case where the rotating member is provided on an end side in the width direction.

In general, the sheet, which is transported by the transport roller to the downstream side in the transport direction, comes into contact with the gate member, so that the sheet is deformed to be bent. Then, torque occurs in the bent sheet so as to urge the sheet to be restored to the original shape. Further, a rotating operation of the sheet in accordance with the torque is changed depending on the kind of sheet. For example, when the sheet is thick and has high rigidity, it is unlikely to be deformed compared with a sheet with low rigidity. For this reason, when a sheet with high rigidity is deformed so as to come into contact with the first guide member, force applied on the first guide member is larger than force generated by deformation of the sheet with low rigidity. As the frictional resistance between the sheet and the first guide member increases, the rotation of the sheet is hindered.

According to such a configuration, since the sheet comes into contact with the rotating member, the frictional resistance is smaller than that in a case where the sheet comes into contact with the first guide member. Therefore, it is possible to reduce deviation in the rotation of a different kind of sheet, and the sheet can sufficiently rotate at the time of correcting skew regardless of the kind of sheet. Furthermore, since the rotating member is provided in the center in the width direction intersecting the transport direction of the sheet so as to protrude into the transport passage, the sheet can be subjected to skew correction through which the rotation direction of the sheet is changed so as to move in relation to the rotating member according to the direction of the inclination (skew) of the sheet with respect to the transport direction.

In the skew correction device according to the invention, the rotating member includes a spherical member which comes into contact with the sheet and a support member which rotatably supports the spherical member.

According to such a configuration, since the sheet comes into point contact with the spherical member, the contact area becomes smaller than in the case where the sheet comes into contact with a cylindrical roller, for example. That is, the contact resistance of the sheet becomes smaller, so that the sheet can easily rotate. Furthermore, since the spherical member also freely rotates, it is possible to easily change the contact point between the sheet and the spherical member. For this reason, even when the sheet is highly skewed with respect to the transport passage, the sheet smoothly moves on the surfaces of the spherical member in the rotation direction at the time of correcting the skew. Therefore, for example, even though a large amount of inclination occurs in a direction different from the rotation direction of the cylindrical roller so that the inclination is not corrected completely in the cylindrical roller, the inclination can be corrected regardless of the direction.

In the skew correction device according to the invention, an oscillating device is further included, which oscillates the first guide member.

According to such a configuration, the oscillation device oscillates the sheet, which is supported by the first guide member, via the first guide member. That is, the sheet comes into slidable contact with the first guide member and the second guide member, so that frictional resistance is reduced. Therefore, the sheet can easily rotate.

In the skew correction device according to the invention, the gate member includes a driving roller which is rotatably driven by driving force transferred from a drive source and a driven roller which comes into contact with a lower side of the driving roller in a vertical direction so as to be rotatably driven. Here, the first guide member includes a claw section which protrudes into the transport passage toward the driving roller and guides the transported sheet toward the driving roller.

According to such a configuration, since the first guide member includes a claw section which protrudes into the transport passage toward the driving roller and guides the transported sheet toward the driving roller, the transported sheet can come into contact with the driving roller. Therefore, the inclination of the sheet is corrected in order that the tip end of the sheet comes into contact with the driving roller along the width direction thereof, and then the driving roller rotates, so that the sheet can be delivered to the downstream side in the transport direction while in a state where the inclination is corrected. That is, it is possible to suppress the inclination of the sheet which occurs when the transportation is restarted.

According to another aspect of the invention, there is provided a recording apparatus which includes the skew correction device as described above; and a recording unit for performing a recording process on the sheet which is subjected to the positional correction.

According to such a configuration, since the recording is performed on the sheet of which the inclination is corrected with respect to the transport direction by the skew correction device, deviation in recording on the sheet is suppressed. Therefore, it is possible to improve the recording quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described through embodiments in which a printer is specified as a kind of a recording apparatus with reference to FIGS. 1 to 5. Further, in the following descriptions, when "longitudinal direction", "horizontal direction", and "vertical direction" are referred, it is assumed that these directions are indicated with reference to directions of arrows illustrated in each drawing.

Figure 1:
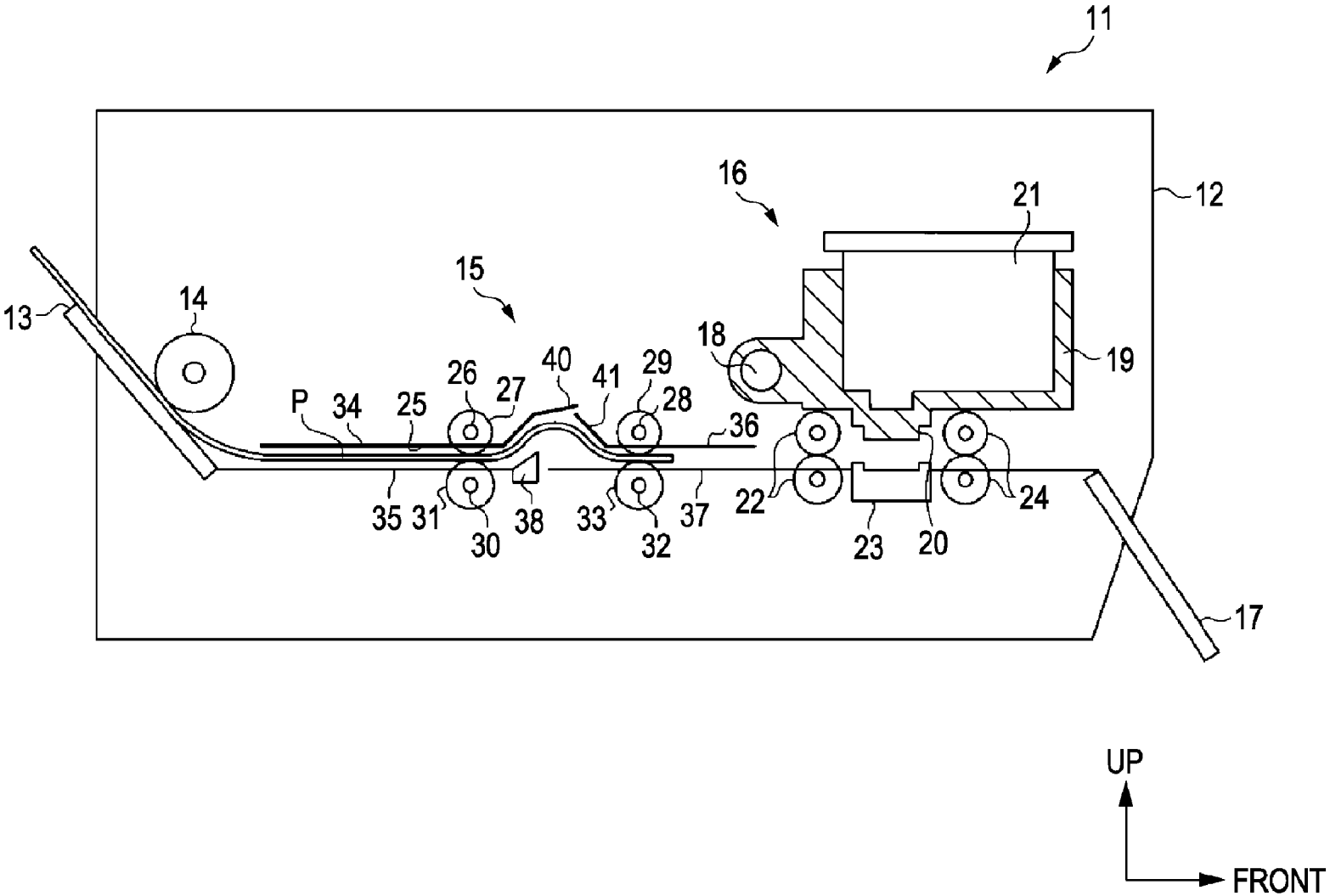
FIG. 1 is a front view schematically illustrating a recording apparatus according to an embodiment.

A printer 11 as shown in FIG. 1 is a large-scale ink jet printer which can perform printing on a size of A1 or B1. The printer 11 is provided with a main frame 12, and a set unit 13, which can set the sheet P such as a recording paper, in a back surface side of the main frame 12.

In addition, the main frame 12 accommodates a feeding roller 14 for delivering the sheets P which are set on the set unit 13, a skew correction device 15 for performing positional correction of the delivered sheets P, and a printing device 16 to implement recording by performing a print process on the sheets P which are subjected to the positional correction. Furthermore, in a front surface side of the main frame 12, a discharge unit 17 is provided to guide the sheets P which are subjected to the print process and discharged from the main frame 12.

The printing device 16 extends in a horizontal direction (a direction perpendicular to the paper in FIG. 1). The printing device 16 is provided with a rod-shaped guide shaft 18 of which both the right and left ends are supported by the main frame 12, a carriage 19 which is supported by the guide shaft 18 so as to be reciprocally moved in the horizontal direction, and a recording head 20 which is provided on a lower surface side of the carriage 19. Then, the carriage 19 can be moved in the horizontal direction, which is a scanning direction, in accordance with the driving of a carriage motor (not shown).

In the main frame 12, an ink cartridge (not shown) containing ink is mounted so as to be attached thereto or detached therefrom, and the mounted ink cartridge is connected to an upstream end of an ink supply passage (not shown). On the carriage 19, a valve unit 21 is mounted such that a downstream end of the ink supply passage is connected thereto. Then, the ink contained in the ink cartridge is pressured and fed to the valve unit 21 through the ink supply passage by a pressing pump (not shown), so that the ink is supplied from the valve unit 21 to the recording head 20. In addition, on the lower surface side of the recording head 20, nozzle openings (not shown) are provided so as to eject the ink.

On the lower side of the carriage 19, there are provided a sending roller pair 22 disposed in a rear position of the recording head 20, a platen 23 which is a support base of the sheet P disposed in a lower position of the recording head 20 and in a forward position of the sending roller pair 22, and a sending roller pair 24 disposed in a forward position of the platen 23. Then, a sending process of transporting the sheet P by a predetermined distance toward the forward side which is the downstream side in the transport direction by the sending roller pairs 22 and 24, and a print process of ejecting ink from the nozzle openings of the recording head 20 which is moved in the scanning direction (horizontal direction) together with the carriage 19 are alternatively carried out, so that the recording process is carried out on the sheet P.

In addition, the skew correction device 15 is provided in the middle of the transport passage 25 through which the sheet P is transported toward the printing device 16. Specifically, in order to transport the sheet P, which is delivered by the feeding roller 14, toward the forward side which is the downstream side in the transport direction, there are provided on the transport passage 25 a metal transport roller 27 which rotates in accordance with rotational driving of a driving shaft 26 and a resist roller 29, as a gate member and a driving roller, which is disposed in the downstream side (forward side) in the transport direction from the transport roller 27 and is driven in accordance with rotational driving of a driving shaft 28 which transfers driving force from a driving source (not shown). Then, on the lower side of the transport roller 27 in a vertical direction (up-down direction), a driven roller 31 made of hard rubber, which rotates about a rotary shaft 30 in accordance with the transport roller 27, is provided so as to make a pair with the transport roller 27. In addition, on the lower side of the resist roller 29, a driven roller 33 as the gate member, which rotates about a rotary shaft 32 in accordance with rotation of the resist roller 29, is provided so as to make a pair with the resist roller 29.

In the skew correction device 15, by making the transport roller 27 rotate in a counterclockwise direction in FIG. 1 in a state where the resist roller 29 has stopped rotating, the sheet P is transported toward the forward side so as to come into contact with the resist roller 29. Then, from this state, the transport roller 27 further rotates by a predetermined distance, so that skew correction is carried out on the sheet P.

Figure 2:
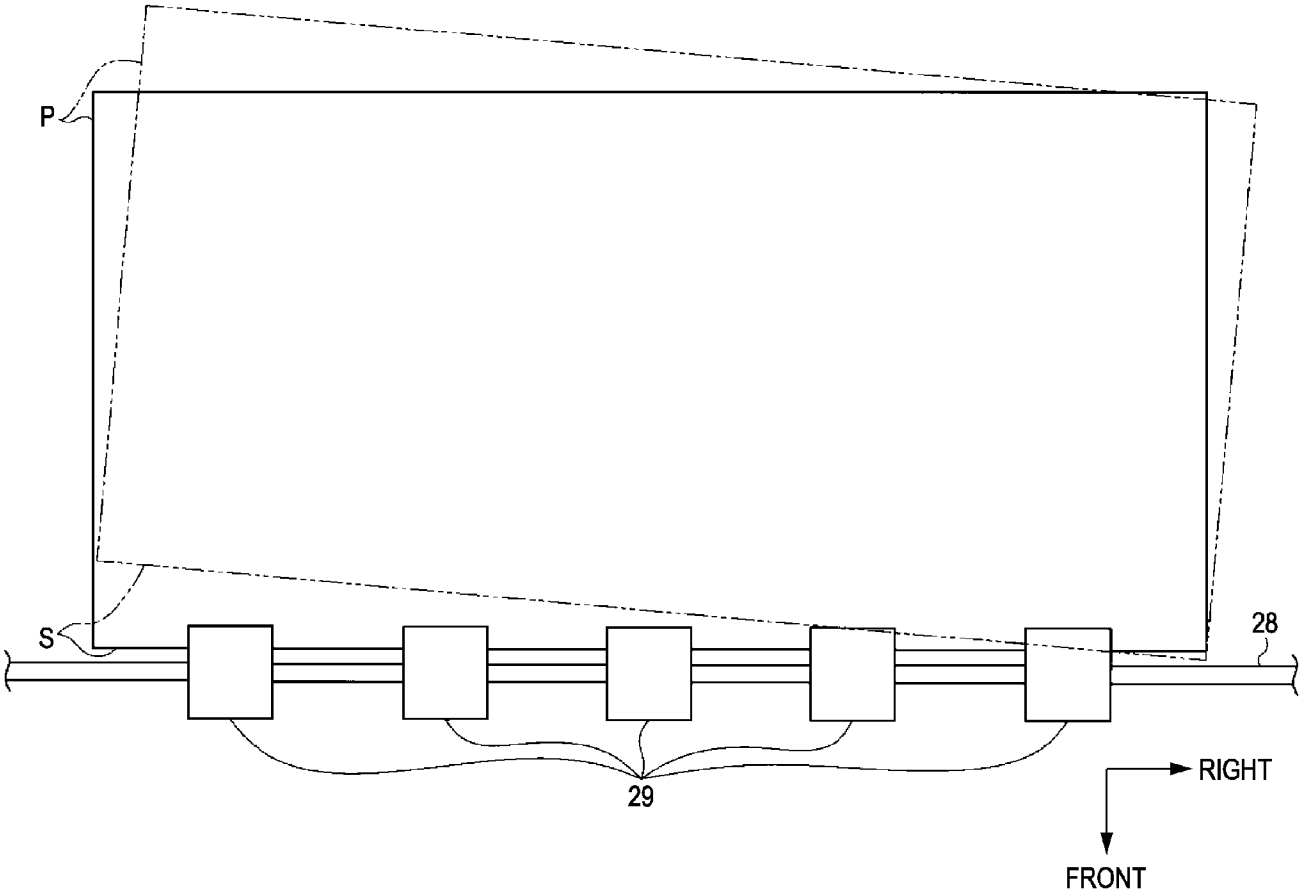
FIG. 2 is a diagram illustrating skew correction.

Here, as shown in FIG. 2, the skew correction means that positional correction is carried out on the sheet P such that the tip end S extending in a horizontal direction of the rectangular sheet P in plan view is to be an aligned state (the state illustrated in a solid line as shown in FIG. 2) perpendicular to the transport direction (longitudinal direction). That is, in order to properly carry out the recording process, it is necessary for the sheet P to be in the aligned state so as to be supplied to the printing device 16. However, since the tip end S of the sheet P is in a skewed state (the state illustrated in a double-dotted line as shown in FIG. 2) not perpendicular to the transport direction when the sheet is delivered or transported, the positional correction of the sheet P is carried out by the skew correction device 15.

Specifically, for example, when the sheet P is transported in the skewed state where the right end side of the sheet P is preceding, the right end side of the tip end S of the sheet P first comes into contact with the resist roller 29. Then, when the transport roller 27 is further driven to rotate from this state, the sheet P is slowly bent upward and rotates around the right end side which comes into contact with the resist roller 29, and the left end side of the tip end comes into contact with the resist roller 29, so that the positional correction is carried out. After such a positional correction is carried out, the resist roller 29 rotates in the counterclockwise direction in FIG. 1, so that the aligned sheet P is transported to the printing device 16.

Next, the configuration of the skew correction device 15 will be described.

As shown in FIG. 1, on the transport passage 25, a transport passage forming member 34 which is disposed in the vicinity of the transport roller 27, a transport passage forming member 35 which is disposed in the vicinity of the driven roller 31, a transport passage forming member 36 as a second guide member which is disposed in the vicinity of the resist roller 29, and a transport passage forming member 37 as a first guide member which is disposed in the vicinity of the driven roller 33. Then, the sheet P is transported from the upstream side (back side) to the downstream side (front side) of the transport passage 25, while the surface (upper surface) subjected to the print process is guided so as to face the transport passage forming members 34 and 36 and the rear surface (lower surface) is guided so as to face the transport passage forming members 35 and 37.

Between the transport passage forming members 35 and 37, there is disposed a lower guide member 38 which raises the tip end of the transported sheet P upward so as to cause bending deformation to start. In addition, the transport passage forming member 34 is formed such that the front end side thereof is bent in two stages upward, and is configured with an upper guide member 40 which pushes the sheet P downward. The sheet P is guided to the lower guide member 38 and transported in an inclined upper direction with respect to the transport direction. Further, the transport passage forming member 36 is formed such that the rear side thereof is bent upward, and is configured with a guide plate 41 which guides the tip end of the sheet P to the resist roller 29. That is, in the skew correction device 15, the sheet P is introduced by the lower guide member 38 and the bending deformation of the sheet P is controlled by the upper guide member 40 and the guide plate 41, so that the positional correction is carried out with high accuracy.

Next, the transport passage forming member 37 will be described.

Figure 3:
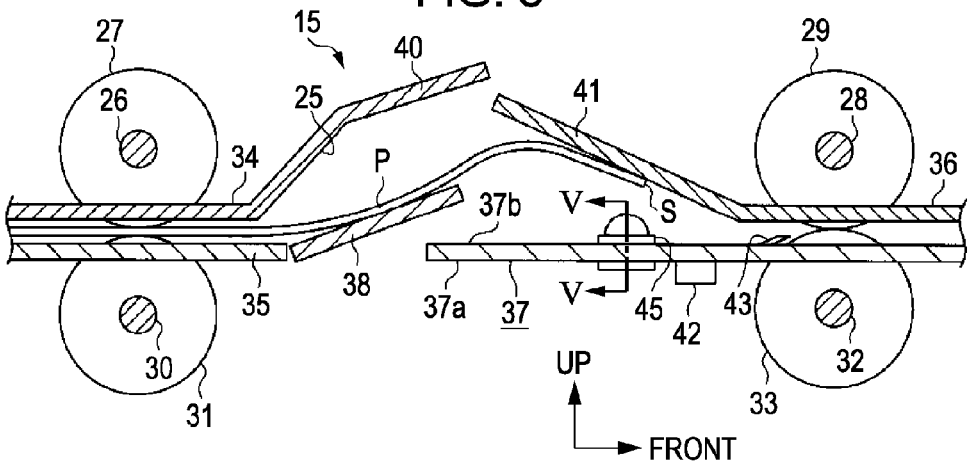
FIG. 3 is a cross-sectional view schematically illustrating a skew correcting apparatus.
Figure 4:
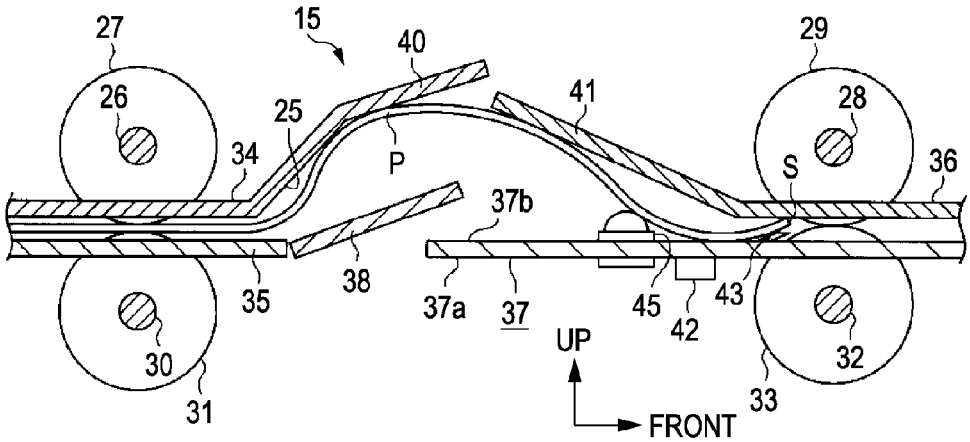
FIG. 4 is a cross-sectional view schematically illustrating a skew correcting apparatus.

As shown in FIGS. 3 and 4, an oscillating device 42 such as a vibrator which can oscillate the transport passage forming member 37 is provided on the lower surface 37*a*, which is located on the rear side of the driven roller 33 of the transport passage forming member 37 and the outside of the transport passage 25. That is, since the sheet P is guided to the resist roller 29 while coming into slidable contact with the transport passage forming member 37 little by little, it is possible to reduce the frictional force which acts on the sheet in a direction against transportation of the sheet P.

Furthermore, a claw section 43 is formed on the rear side of the driven roller 33 on the transport passage forming member 37 so as to face the driven roller 33. The claw section 43 protrudes toward the upside from the upper surface 37*b*. For this reason, the transported sheet P is guided toward the resist roller 29 along the claw section 43.

Figure 5:
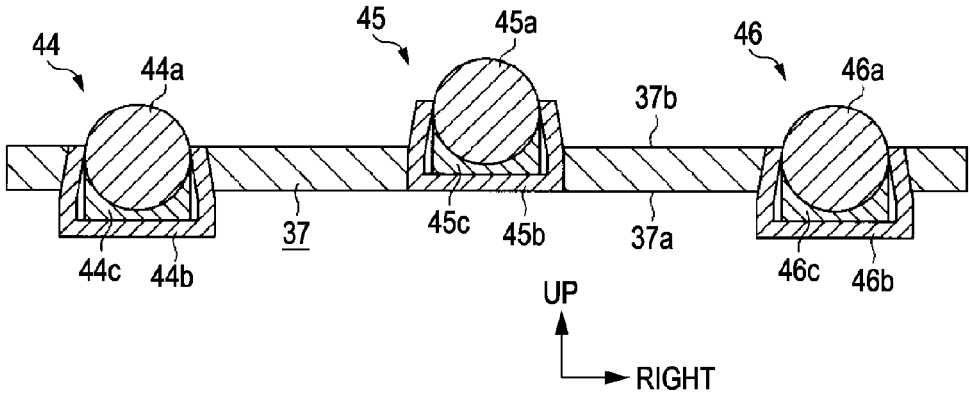
FIG. 5 is a cross-sectional view taken along a line V-V as shown in FIG. 3.

In addition, as shown in FIG. 5, at least one (three pieces in this embodiment) of the spherical small rollers 44, 45, and 46 as a rotating member is provided in the transport passage forming member 37 along an axial direction (horizontal direction) intersecting the transport direction such that spherical bodies 44*a*, 45*a*, and 46*a* as a spherical member protrudes to the upper side from an upper surface 37*b* of the transport passage forming member 37. That is, the spherical bodies 44*a*, 45*a*, and 46*a* of the respective small rollers 43, 44, and 45 are provided such that the spherical surfaces thereof face the transport passage 25. Then, the spherical small rollers 44, 45, and 46 are provided such that the spherical surface of the spherical small roller 45 provided on the center in the width direction intersecting the transport direction is positioned further up than the spherical small rollers 44 and 46 provided on both right and left ends.

These spherical small rollers 44, 45, and 46 include housings 44*b*, 45*b*, and 46*b* as a support member in a bottomed cylindrical shape in which the upper end is tapered down so that each diameter of the upper end openings is becomes smaller than that of the spherical bodies 44*a*, 45*a*, and 46*a*. Then, inside the housings 44*b*, 45*b*, and 46*b*, are accommodated the spherical bodies 44*a*, 45*a*, and 46*a*, guide members 44*c*, 45*c*, and 46*c* as support members having spherical surfaces with which the respective spherical bodies 44*a*, 45*a*, and 46*a* come into slidable contact. Therefore, the spherical bodies 44*a*, 45*a*, and 46*a* are supported by the housing 44*b*, 45*b*, and 46*b* and the guide members 44*c*, 45*c*, and 46*c*, so that the rotation direction thereof may be freely changed.

For this reason, as shown in FIG. 4, the spherical small rollers 44, 45, and 46 are configured such that, when the bent sheet P comes into contact therewith, the spherical bodies 44*a*, 45*a*, and 46*a* rotate and thus the contact points with the sheet P may be freely changed on the sheet P.

Therefore, as shown in FIG. 3, the transported sheet P is deformed to be bent upward from the lower guide member 38 in accordance with the driving of the transport roller 27, and is guided to the resist roller 29 and the driven roller 33 by the guide plate 41. Then, as shown in FIG. 4, the tip end S of the sheet P is guided to the claw section 43 so as to come into contact with the resist roller 29, so that the sheet P is deformed to be bent. Therefore, since the sheet P is subjected to the positional correction while coming into contact with the spherical small rollers 44, 45, and 46, the sheet P rotates in a state where the force being applied in a direction (horizontal direction) against the positional correction is reduced.

According to the above-mentioned embodiment, the following effects can be obtained.

(1) Since the sheet P, which is transported to the downstream side in the transport direction by the transport roller 27, comes into contact with the spherical small rollers 44, 45, and 46, the friction resistance thereof becomes smaller than that in the case where the sheet comes into contact with the transport passage forming member 37. Therefore, it is possible to reduce deviation in the rotation of a different kind of sheet P, and the sheet P can sufficiently rotate at the time of correcting skew regardless of the kind of sheet P. Furthermore, since the spherical small rollers 44, 45, and 46 are provided in the center in the width direction intersecting the transport direction of the sheet P such that the surfaces of the spherical bodies 44*a*, 45*a*, and 46*a* protrude into the transport passage 25, the sheet P can be subjected to the skew correction through which the rotation direction of the sheet P is changed so as to move in relation to the spherical small rollers 44, 45, and 46 according to the direction of the inclination (skew) of the sheet P with respect to the transport direction.

(2) Since the sheet P comes into point contact with the spherical bodies 44*a*, 45*a*, and 46*a* the contact area becomes smaller than in the case where the sheet P comes into contact with a cylindrical roller, for example. That is, the contact resistance of the sheet P becomes smaller, so that the sheet P can easily rotate. Furthermore, since the spherical bodies 44*a*, 45*a*, and 46*a* also freely rotate, it is possible to easily change the contact point between the sheet P and the spherical bodies 44*a*, 45*a*, and 46*a*. For this reason, even when the sheet P is greatly skewed with respect to the transport passage 25, the sheet P smoothly moves on the surfaces of the spherical bodies 44*a*, 45*a*, and 46*a* in the rotation direction at the time of correcting the skew. Therefore, for example, even though a large amount of inclination occurs in a direction different from the rotation direction of a cylindrical roller so that the inclination is not corrected completely in the cylindrical roller, the inclination can be corrected regardless of the direction.

(3) The oscillating device 42 oscillates the sheet P supported by the transport passage forming member 37 via the transport passage forming member 37. That is, the sheet P comes into slidable contact with the transport passage forming members 36 and 37, so that frictional resistance is reduced. Therefore, the sheet P can easily rotate.

(4) Since the transport passage forming member 37 includes the claw section 43 which protrudes into the transport passage 25 toward the resist roller 29 and guides the transported sheet P toward the resist roller 29, the transported sheet P can come into contact with the resist roller 29. Therefore, the inclination of the sheet P is corrected in order that the tip end of the sheet P comes into contact with the resist roller 29 along the width direction thereof, and then the resist roller 29 rotates, so that the sheet P can be delivered to the downstream side (front side) in the transport direction while in a state where the inclination is corrected. That is, it is possible to suppress the inclination of the sheet P which occurs when the transportation is restarted.

(5) Since the recording is performed on the sheet P of which the inclination is corrected with respect to the transport direction by the skew correction device 15, deviation in the recording on the sheet P is suppressed. Therefore, it is possible to improve recording quality.

Further, the above-mentioned embodiment may be changed as described below.

In the above-mentioned embodiment, the claw section 43 may not need to be provided. In addition, the rear end portion of the transport passage forming member 37 is subjected to a downward bending process such that the vicinity of the driven roller 33 becomes the top position, so that the sheet P can be guided to the resist roller 29 by the transport passage forming member 37.

In the above-mentioned embodiment, the oscillation device 42 may not need to be provided.

In the above-mentioned embodiment, three spherical small rollers 44, 45, and 46 are provided, but the configuration may be changed such that only the spherical small roller 45 disposed in the center is provided. In addition, plural spherical small rollers may be provided in the center. In this case, the spherical small rollers are preferably disposed upward the closer they are disposed to the center. Then, the number of the spherical small rollers and the positions thereof can be arbitrarily set in the transport passage forming member 37.

In the above-mentioned embodiment, the rotating members are configured as the spherical small rollers 44, 45, and 46 which have no limitation regarding the rotation direction. However, for example, there may be employed a small roller of which a shaft is inserted through the center of the spherical bodies 44*a*, 45*a*, and 46*a* so as to rotate about the shaft as the center. Further, there may be employed a cylindrical rotating body which freely rotates about a shaft. In addition, these configurations may be employed together.

In the above-mentioned embodiment, the gate member is not limited to the resist roller 29, but may be realized as a plate-like member which can move in the vertical direction.

In the above-mentioned embodiment, the recording apparatus is specified as the large-scaled ink jet printer 11, but the invention is not limited thereto. For example, the skew correction device may be provided at a small-scaled recording apparatus which performs printing of an A4 size, a printer operated by a different manner such as an electrophotographic method, a FAX machine, a copying machine, or a multifunction machine or the like which is provided with these plural functions. Further, there may be employed a liquid ejecting apparatus which ejects or discharges a liquid other than ink. The skew correction device may be employed in various liquid ejecting apparatuses each providing with a liquid ejecting head for discharging a minute amount of liquid droplets. Further, the liquid droplet means a state of the liquid which is discharged from the liquid ejecting apparatus, which includes a liquid droplet having a tail drawn in a granular shape, a tear shape, or a thread shape. In addition, the liquid droplet as described above is not particularly limited as long as it is a material which can be ejected by the liquid ejecting apparatus. For example, any material may be employed as long as the material is in a liquid form, and include a liquid with a high or low viscosity property, sol, gel water, and materials that flow such as inorganic solvents, organic solvents, solutions, liquid resin, liquid metal (metal melt). In addition to a liquid as one state of matter, there may include materials in which particles of a functional material consisting of solid matter such as pigments or metal particles are dissolved, dispersed, or mixed with a solvent. In addition, as a representative example of a liquid, ink as described in the above-mentioned embodiment or liquid crystal is exemplified. Here, it is assumed that the ink includes water-based ink, oil-based ink, and various liquid compositions such as gel ink, and hot melt ink or the like. As a specific example of the liquid ejecting apparatus, for example, a liquid ejecting apparatus which ejects a liquid in which a material such as an electrode material or a coloring material used for manufacturing color filters, a liquid crystal display, an electroluminescence (EL) display, and a surface emitting display, is dispersed or dissolved, a liquid ejecting apparatus which ejects a biological organic material used for manufacturing bio chips, a liquid ejecting apparatus which ejects a liquid as a sample used as a precise pipette, a textile printing apparatus, a micro dispenser, or the like may be employed. Furthermore, a liquid ejecting apparatus which ejects a lubricant onto a precision machine such as a clock or a camera using a pin point, a liquid ejecting apparatus which ejects transparent resin such as ultraviolet cure resin onto a substrate in order to form lenses (optical lenses) with a minute radius used in optical communication elements, and a liquid ejecting apparatus which ejects an etching liquid such as an acid liquid or an alkali liquid in order to etch substrates may be also employed. The invention can be applied to any one of these liquid ejecting apparatuses.

What is claimed is:

1. A skew correction device which performs positional correction of a sheet while a tip end of the sheet transported in accordance with rotation of a transport roller comes into contact with a gate member so as to deform the sheet to be bent, the skew correction device comprising:

a first guide member which supports the sheet transported by the transport roller from a lower side thereof in a vertical direction and guides the sheet to the gate member; and a second guide member which is provided on an upper position from the first guide member in a vertical direction and guides the sheet to the gate member, wherein the first guide member includes at least one rotating member which faces a transport passage of the sheet interposed between the first guide member and the second guide member and is rotatably provided at least in the center of the second guide member in a width direction intersecting a transport direction of the sheet, and wherein the rotating member has a center protruding portion disposed in the center of the rotating member in the width direction and at least one end protruding portion disposed in an end of the rotating member in the in the width direction which protrudes into the transport passage, wherein the center protruding portion and the at least one end protruding portion contact the sheet when guiding the sheet to the gate member, and wherein the center protruding portion protrudes more into the transport passage than the at least one end protruding portion.

2. The skew correction device according to claim 1, wherein the rotating member includes a spherical member which comes into contact with the sheet and a support member which rotatably supports the spherical member.

3. The skew correction device according to claim 1, further comprising:

an oscillating device for oscillating the first guide member.

4. The skew correction device according to claim 1, wherein the gate member includes a driving roller which is rotatably driven by driving force transferred from a drive source and a driven roller which comes into contact with a lower side of the driving roller in a vertical direction so as to be rotatably driven, and wherein the first guide member includes a claw section which protrudes into the transport passage toward the driving roller and guides the transported sheet toward the driving roller.

5. A recording apparatus comprising:

the skew correction device according to claim 1; and a recording unit for performing a recording process on the sheet which is subjected to the positional correction.

* * * * *